US006923642B2

(12) United States Patent
Sennoun et al.

(10) Patent No.: US 6,923,642 B2
(45) Date of Patent: Aug. 2, 2005

(54) PREMIXED PREVAPORIZED COMBUSTOR

(75) Inventors: Mohammed E. H. Sennoun, Rochester, NY (US); Daniel Miller, Rochester, NY (US)

(73) Assignee: General Motors Corporation, Detroit, MI (US)

( * ) Notice: Subject to any disclaimer, the term of this patent is extended or adjusted under 35 U.S.C. 154(b) by 76 days.

(21) Appl. No.: 10/681,680

(22) Filed: Oct. 8, 2003

(65) Prior Publication Data

US 2005/0079462 A1 Apr. 14, 2005

(51) Int. Cl.[7] ..... F23D 11/44
(52) U.S. Cl. ..... 431/243; 431/246
(58) Field of Search ..... 431/243, 245, 431/246

(56) References Cited

U.S. PATENT DOCUMENTS

| | | | | |
|---|---|---|---|---|
| 3,938,326 A | | 2/1976 | DeCorso et al. | |
| 4,313,721 A | * | 2/1982 | Henriques | 431/265 |
| 4,375,949 A | | 3/1983 | Salooja | |
| 4,650,727 A | | 3/1987 | Vanderborgh et al. | |
| 4,731,989 A | | 3/1988 | Furuya et al. | |
| 5,127,221 A | * | 7/1992 | Beebe | 60/772 |
| 5,431,017 A | | 7/1995 | Kobayashi et al. | |
| 5,572,862 A | * | 11/1996 | Mowill | 60/39.23 |
| 5,623,819 A | | 4/1997 | Bowker et al. | |
| 5,628,181 A | | 5/1997 | Kraemer | |
| 5,664,942 A | | 9/1997 | Bayer | |
| 5,680,767 A | * | 10/1997 | Lee et al. | 60/760 |
| 5,725,964 A | | 3/1998 | Huppmann | |
| 5,837,205 A | | 11/1998 | Bayer et al. | |
| 6,000,212 A | | 12/1999 | Kolaczkowski et al. | |
| 6,077,620 A | | 6/2000 | Pettit | |
| 6,083,425 A | | 7/2000 | Clawson et al. | |
| 6,123,913 A | | 9/2000 | Clawson et al. | |
| 6,126,908 A | | 10/2000 | Clawson et al. | |
| 6,213,757 B1 | | 4/2001 | Kushch et al. | |
| 6,224,370 B1 | | 5/2001 | Tomizawa et al. | |
| 6,306,531 B1 | | 10/2001 | Clingerman et al. | |
| 6,386,862 B1 | | 5/2002 | Fujita et al. | |
| 6,521,204 B1 | | 2/2003 | Borup et al. | |

* cited by examiner

*Primary Examiner*—Alfred Basichas
(74) *Attorney, Agent, or Firm*—Harness, Dickey & Pierce, P.L.C.

(57) ABSTRACT

The present invention is an improved a combustor incorporating a pre-mix/pre-evaporation chamber arranged and configured to produce both a cool portion and a hot portion that cooperate to vaporize a liquid fuel to produce a lean to low-rich combustion mixture that is ejected from chamber into the combustor where is then ignited to produce a stable non-sooting flame maintained substantially within a combustion zone that yields a clean hot exhaust stream for heating downstream process components or processes such as one or more components of an autothermal reformer (ATR).

20 Claims, 7 Drawing Sheets

12
18
2
11
10

PREMIXED PREVAPORIZED COMBUSTOR

FIELD OF THE INVENTION

The present invention generally relates to fuel processors and, more particularly, relates to a fuel processor having a combustion system for rapid start of the fuel processor and a combustor for use in such a system.

BACKGROUND OF THE INVENTION $H_2$—$O_2$ fuel cells use hydrogen ($H_2$) as a fuel and oxygen (typically from air) as an oxidant. The hydrogen used in the fuel cell can be derived from reforming a hydrocarbon fuel (e.g., methanol or gasoline). For example, in a steam reforming process, a hydrocarbon fuel (such as methanol) and water (as steam) are ideally reacted in a catalytic reactor (commonly referred to as a "steam reformer") to generate a reformate gas comprising primarily hydrogen and carbon monoxide. An exemplary steam reformer is described in U.S. Pat. No. 4,650,727 to Vanderborgh.

For another example, in an autothermal reforming process, a hydrocarbon fuel (such as gasoline), air and steam are ideally reacted in a combined partial oxidation and steam reforming catalytic reactor (commonly referred to as an autothermal reformer or ATR) to generate a reformate gas containing hydrogen and carbon monoxide. An exemplary autothermal reformer is described in U.S. application Ser. No. 09/626,553 filed Jul. 27, 2000. The reformate exiting the reformer, however, contains undesirably high concentrations of carbon monoxide, most of which must be removed to avoid poisoning the catalyst of the fuel cell's anode. In this regard, the relatively high level of carbon monoxide (i.e., about 3–10 mole %) contained in the $H_2$-rich reformate exiting the reformer must be reduced to very low concentrations (e.g., less than 200 ppm and typically less than about 20 ppm) to avoid poisoning the anode catalyst.

It is known that the carbon monoxide, CO, level of the reformate exiting a reformer can be reduced by utilizing a so-called "water gas shift" (WGS) reaction wherein water (typically in the form of steam) is combined with the reformate exiting the reformer, in the presence of a suitable catalyst. Some of the carbon monoxide (e.g., as much as about 0.5 mole % or more) will survive the shift reaction so that the shift reactor effluent will comprise hydrogen, carbon dioxide, water carbon monoxide, and nitrogen.

As a result, the shift reaction alone is typically not adequate to reduce the CO content of the reformate to levels sufficiently low (e.g., below 200 ppm and preferably below 20 ppm) to prevent poisoning the anode catalyst. It remains necessary, therefore, to remove additional carbon monoxide from the hydrogen-rich reformate stream exiting the shift reactor before supplying it to the fuel cell. One technique known for further reducing the CO content of $H_2$-rich reformate exiting the shift reactor utilizes a so-called "PrOx" (i.e., Preferential Oxidation) reaction conducted in a suitable PrOx reactor under conditions which promote the preferential oxidation of the CO without simultaneously consuming/oxidizing substantial quantities of the $H_2$ fuel or triggering the so-called "reverse water gas shift" (RWGS) reaction. About four times the stoichiometric amount of $O_2$ is used to react with the CO present in the reformate to ensure sufficient oxidation of the CO without consuming undue quantities of the $H_2$.

Reformers for gasoline or other hydrocarbons typically operate at high temperatures (i.e., about 600–800° C.), with water gas shift reactors generally operating at lower temperatures of about 250–450° C., and the PrOx reactors operating at even lower temperatures of about 100–200° C. Thus, it is necessary that the reformer, the water gas shift (WGS) reactor, and the PrOx reactor are each heated to temperatures within their operating ranges for the fuel processor to operate as designed. During the start-up of a conventional fuel processor, however, the heating of various components is typically staged. This sequential approach to heating can lead to undesirable lag time for bringing the system on line. Alternately, external electrical heat sources (i.e., resistance heaters) may be employed to bring the components to proper operating temperatures more quickly, but this approach requires an external source of electricity such as a battery.

Accordingly, there exists a need in the relevant art to provide a fuel processor that is capable of quickly heating the various fuel processor components into their respective operating ranges and complete system startup. Furthermore, there exists a need in the relevant art to provide a fuel processor that maximizes this heat input into the fuel processor while minimizing the tendency to form carbon and to provide a fuel processor capable of heating the fuel processor while minimizing the use of electrical energy during startup and the reliance on catalytic reactions. And further, there exists a need for a combustor design that quickly achieves a stable, non-sooting flame for bringing the fuel processor components into their respective operational temperature ranges.

SUMMARY OF THE INVENTION

According to the principles of the present invention, an improved fuel combustor suitable for incorporation in a fuel processor for rapidly achieving operating temperatures during startup is provided. A combustor according to the present invention may be provided in combination with a reformer, a shift reactor, and a preferential oxidation reactor for producing hydrogen from a hydrocarbon fuel that is used, in turn, for creating electricity in one or more $H_2$—$O_2$ fuel cells.

Other applications for the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. For example, the present invention is hereafter described in the context of a fuel cell fueled by reformed gasoline. However, it is to be understood that the principles embodied herein are equally applicable to fuel cells fueled by other reformable fuels.

Figure 1:
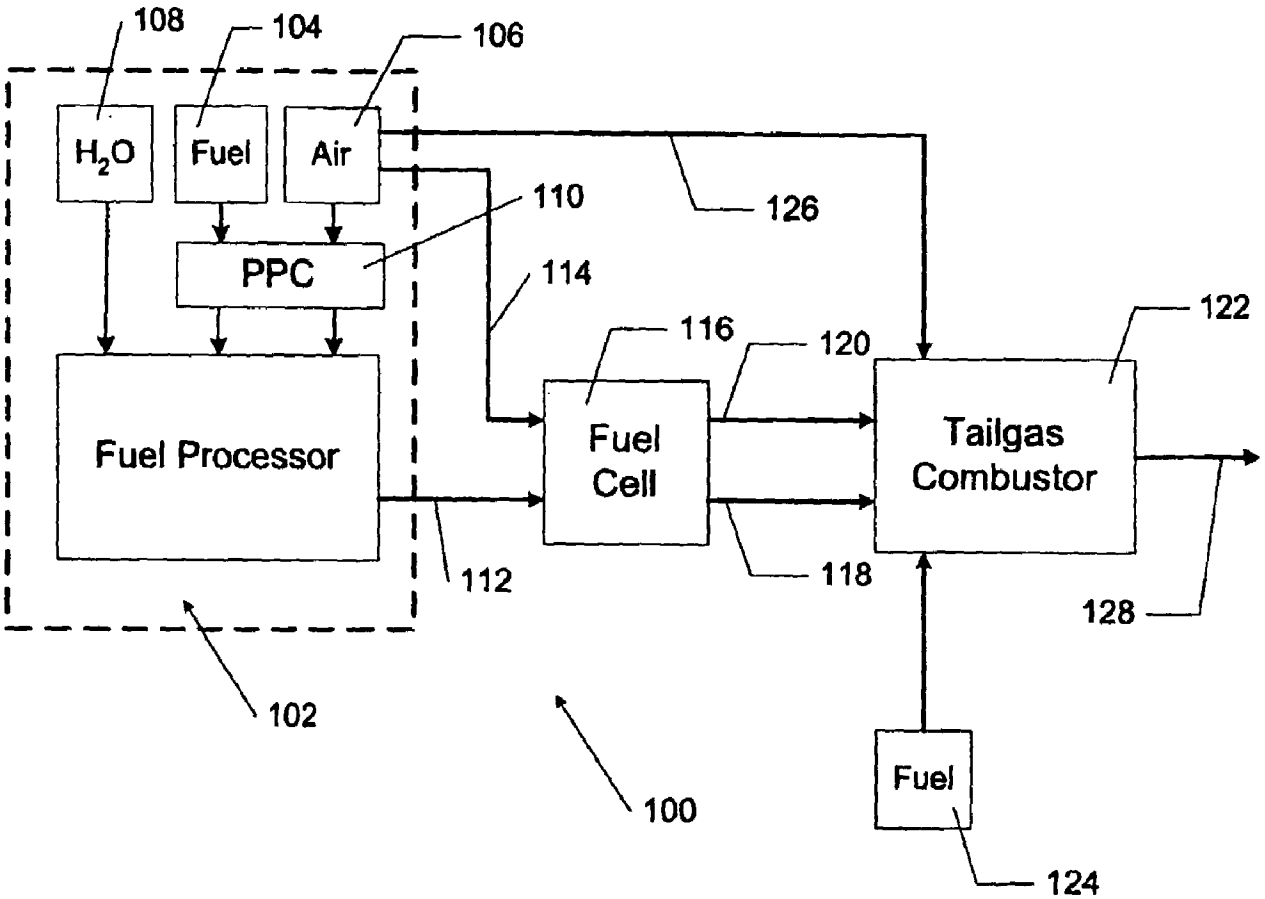
FIG. 1 is a schematic representation of a fuel processing system.

As shown in FIG. 1, a fuel cell system 100 includes a fuel processor 102 for catalytically reacting a reformable hydrocarbon fuel stream 104, air in the form of air stream 106 and water in the form of steam from a water stream 108 in a combination preferential oxidation/steam reforming reaction. A pre-mixed, pre-vaporized combustor (PPC) 110 is used to preheat, vaporize and mix the fuel stream 104 and the air stream 106. The fuel processor 102 contains one or more reactors wherein the reformable hydrocarbon fuel in stream 104 undergoes dissociation in the presence of steam in stream 108 and air in stream 106 to produce the hydrogen-containing reformate which is exhausted from the fuel processor 102 in reformate stream 112. The fuel processor 102 typically also includes one or more clean-up reactors, such as a water-gas shift (WGS) and/or preferential oxidizer (PrOx) reactors which are used to reduce the level of carbon monoxide in the reformate stream 112 to acceptable levels, for example, below 20 ppm. The $H_2$-containing reformate 112 is fed through the anode chamber of a fuel cell stack 116. At the same time, oxygen in the form of an air in stream 114 is fed into the cathode chamber of the fuel cell 116. The hydrogen from the reformate stream 112 and the oxygen from the oxidant stream 114 react in the fuel cell 116 to produce electricity.

Anode exhaust or effluent 118 from the anode side of the fuel cell 116 contains some unreacted hydrogen. Cathode exhaust or effluent 120 from the cathode side of the fuel cell 116 may contain some unreacted oxygen. These unreacted gases represent additional energy which can be recovered in a combustor 122, in the form of thermal energy, for various heat requirements within the system 100. Specifically, a hydrocarbon fuel 124 and/or anode effluent 118 can be combusted, catalytically or thermally, in the tailgas combustor 122 with oxygen provided to the combustor 122 either from air in stream 126 or from the cathode effluent stream 120, depending on system operating conditions. The combustor 122 discharges an exhaust stream 128 to the environment and the heat generated thereby may be directed to the fuel processor 102 as needed.

Figure 2:
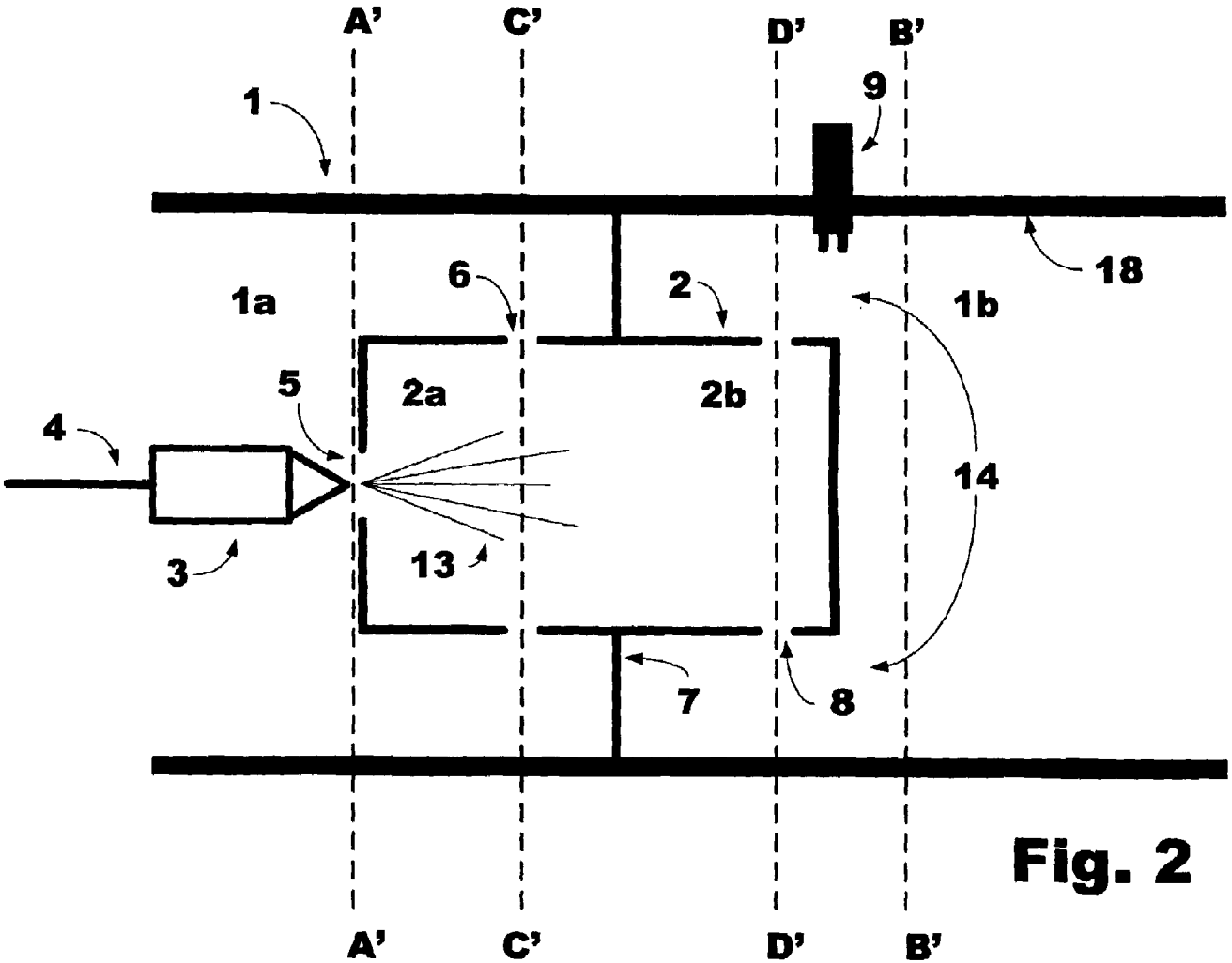
FIG. 2 is a longitudinal cross-sectional view according to a first embodiment of the present invention.
Figures 3A, 3B:
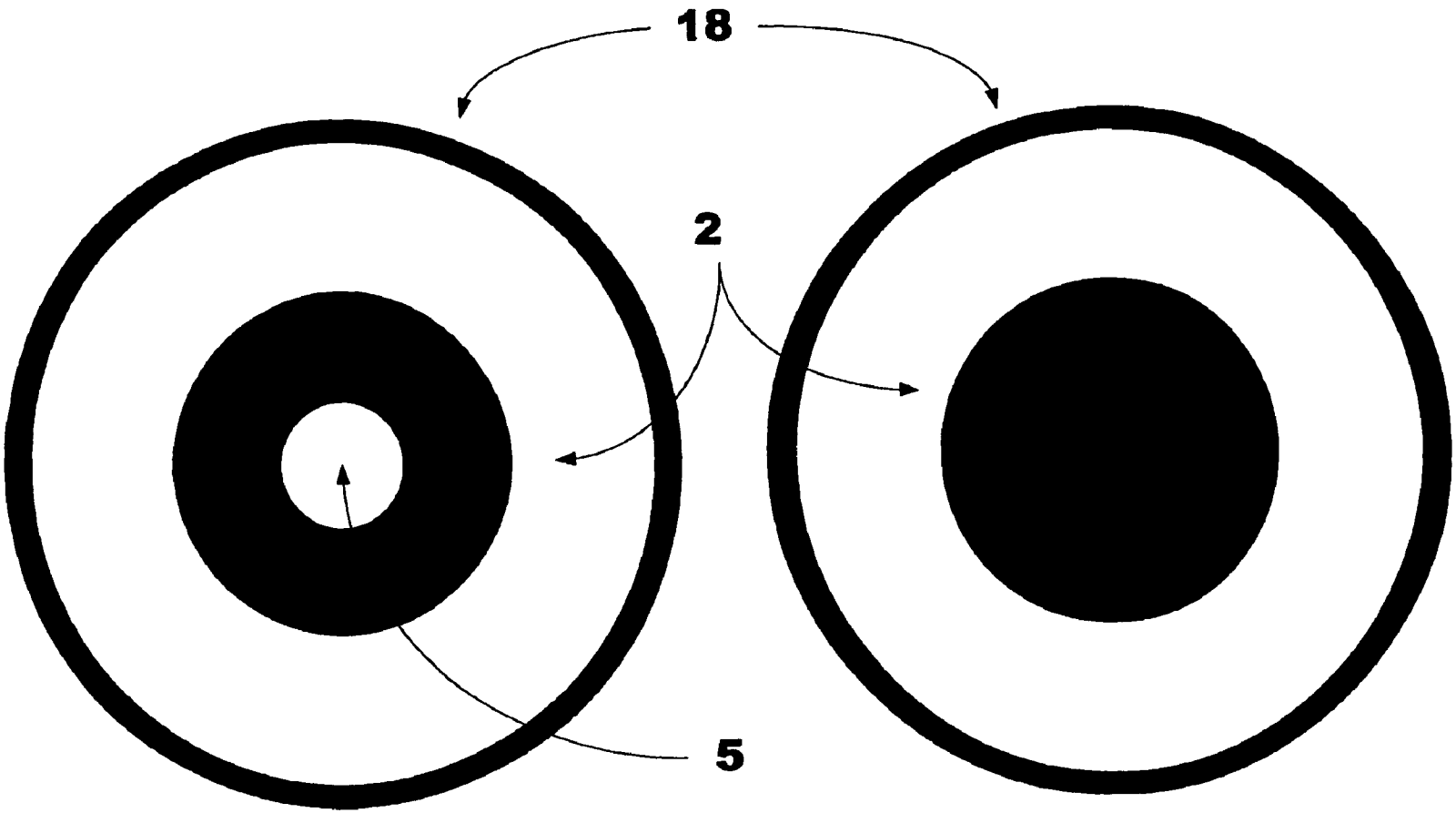
FIG. 3A is cross-sectional view of FIG. 2 taken along line A'—A'.
FIG. 3B is cross-sectional view of FIG. 2 taken along line B'—B'.
Figures 3C, 3D:
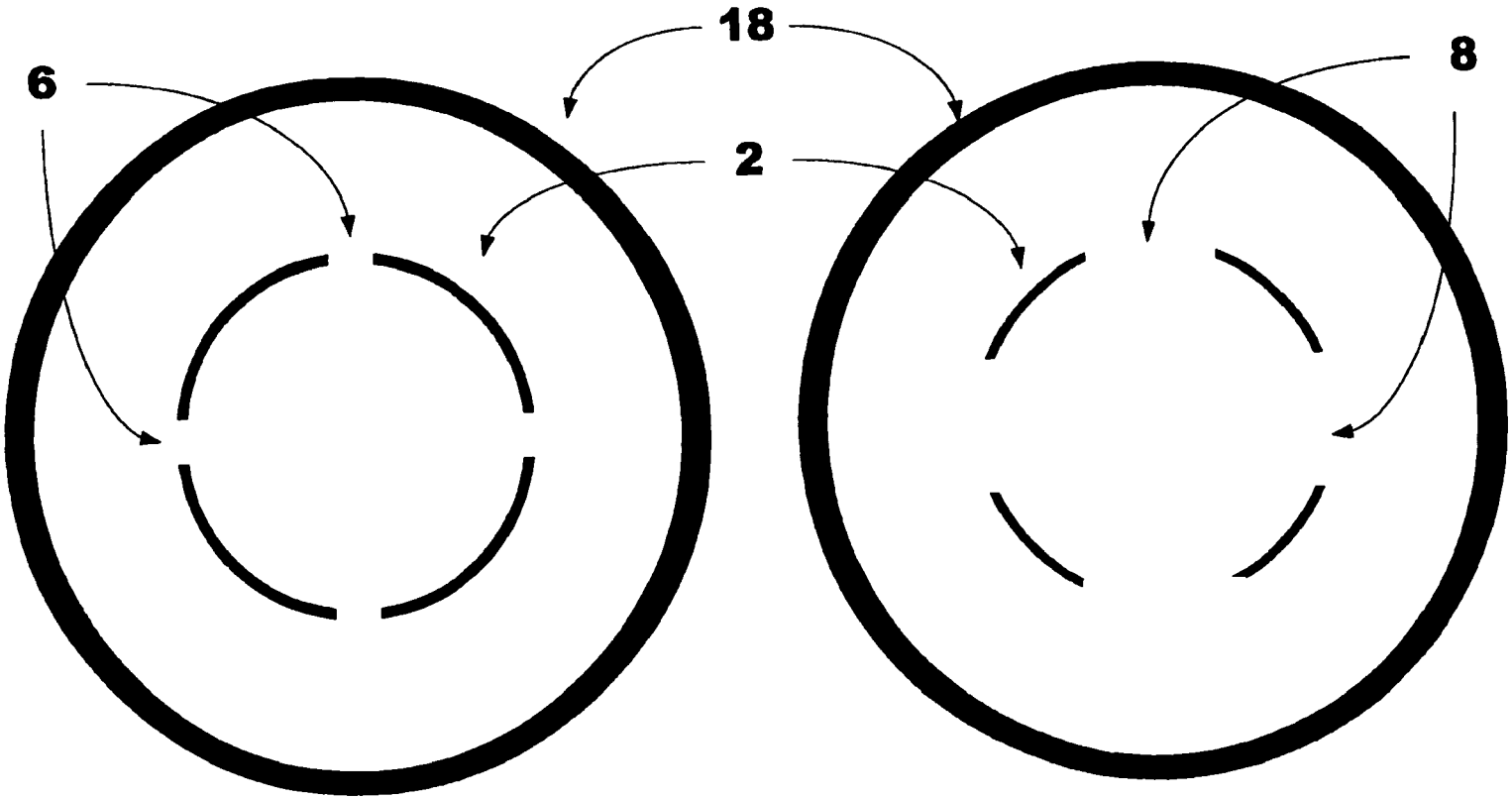
FIG. 3C is cross-sectional view of FIG. 2 taken along line C'—C'.
FIG. 3D is cross-sectional view of FIG. 2 taken along line D'—D'.

Referring to FIG. 2, a combustor 1 according to a first embodiment of the present invention is illustrated. The combustor 1 generally includes a pre-mix/pre-evaporation chamber 2 (PPC) arranged and configured to extend into both a low temperature or cool portion 1*a* and a high temperature or hot portion 1*b* of the combustor, the demarcation between these two portions corresponding generally to a peripheral flange 7 extending from the PPC 2 toward the outer wall of the combustor 1.

The PPC 2 includes both a low temperature or cool portion 2*a* and a high temperature or hot portion 2*b*, a fuel injector 3 for injecting a liquid fuel from fuel line 4 through primary inlet 5 into the cool portion 2*a* of the PPC 2 with a characteristic spray pattern 13. Additional air is preferably introduced into the PPC 2 through one or more secondary inlets 6 arranged around the circumference of the cool portion 2*a* of the PPC 2. The fuel droplets emerging from the fuel injector 3 are thereby mixed with and at least partially evaporated by the air entering the cool portion 2*a* of the PPC 2 to form a mixture of fuel and air. This mixture of fuel and air then flows into the hot portion 2*b* of the PPC 2 where the evaporation of any remaining fuel droplets continues to produce a combustion mixture that is ejected from the hot portion 2*b* of the PPC 2 through one or more outlets 8 into the hot portion 1*b* of the combustor 1. The combustion mixture is then ignited by either one or more igniters 9 or a flame maintained in the vicinity of the outlets 8 to rapidly produce a lean, non-sooting blue flame contained substantially within a combustion zone 14. The combustion products then flow from the combustion zone 14 into the downstream process components or processes, preferably one or more components of an autothermal reformer (ATR). FIGS. 3A–D further illustrate the orientation of the various components comprising a generally cylindrical combustor according to this first embodiment having an axial inlet 5, a plurality of radial inlets 6 and a plurality of radial outlets 8 provided on a substantially cylindrical PPC 2 generally centered within a substantially cylindrical combustion liner.

During operation of the combustor 1, heat radiating from the flame maintained in the combustion zone 14 rapidly heats both the portion of the combustion liner 18 surrounding the combustion zone and walls of the hot portion 2*b* of the PPC 2, further enhancing the evaporation of any remaining droplets of fuel and ensuring that the combustion mixture exiting the PPC 2 is a mixture of only fuel vapor and air. Further, the rate of fuel and air injection into the PPC 2, in combination with the size and location of the radial outlets 8 are preferably selected to maintain the exit velocity of the combustion mixture within a range that will both prevent a flashback condition in which the flame enters the PPC 2 and a blowout condition in which the flame can be extinguished by the flow of the combustion mixture. It is contemplated that for most applications exit velocities of the combustion mixture will be within a range between 5 m/s and 50 m/s.

The relative lengths of the combustor cold and hot parts, $L_c$ and $L_h$, overall length, $L_c+L_h$ of the PPC 2, and the diameter $D_{PPC}$ of the cool portion 2*a* and the hot portion 2*b* of the PPC 2 may also be adjusted to control both the PPC volume, preferably between 0.04 and 0.3 liters, average residence time of the fuel, preferably maintained between 5 and 20 ms, and the average evaporation rate of the fuel droplets entering the PPC 2. The ratio of the volume of air entering the cool portion 2*a* of the PPC 2 through the axial inlet 5, $V_a$, and the volume entering through the radial inlets 6, $V_r$, can also be modified to adjust the manner in which the air and fuel mix within the PPC 2. The flow number and the spray cone angle of the fuel injector 3 are preferably selected in combination with the dimensions of the PPC 2 to eliminate any direct paths into the hot portion 1*b* of the combustor to reduce the likelihood of liquid fuel escaping the PPC 2 unevaporated. Indeed, the fuel injector 3 performance and the dimensions of the PPC 2 may be adjusted so that some portion of the liquid fuel contacts the walls of the hot portion 2*b* of the PPC 2 to aid in the evaporation of the liquid fuel. Similarly, the relative diameters of the PPC 2, $D_{PPC}$, and the combustor liner 18, $D_C$, may be adjusted to control the dimensions of the combustion zone 14 in which the combustion mixture is consumed after exiting the PPC 2 through outlets 8, preferably providing a $D_C/D_{PPC}$ ratio of between 2 and 6.

Figure 4:
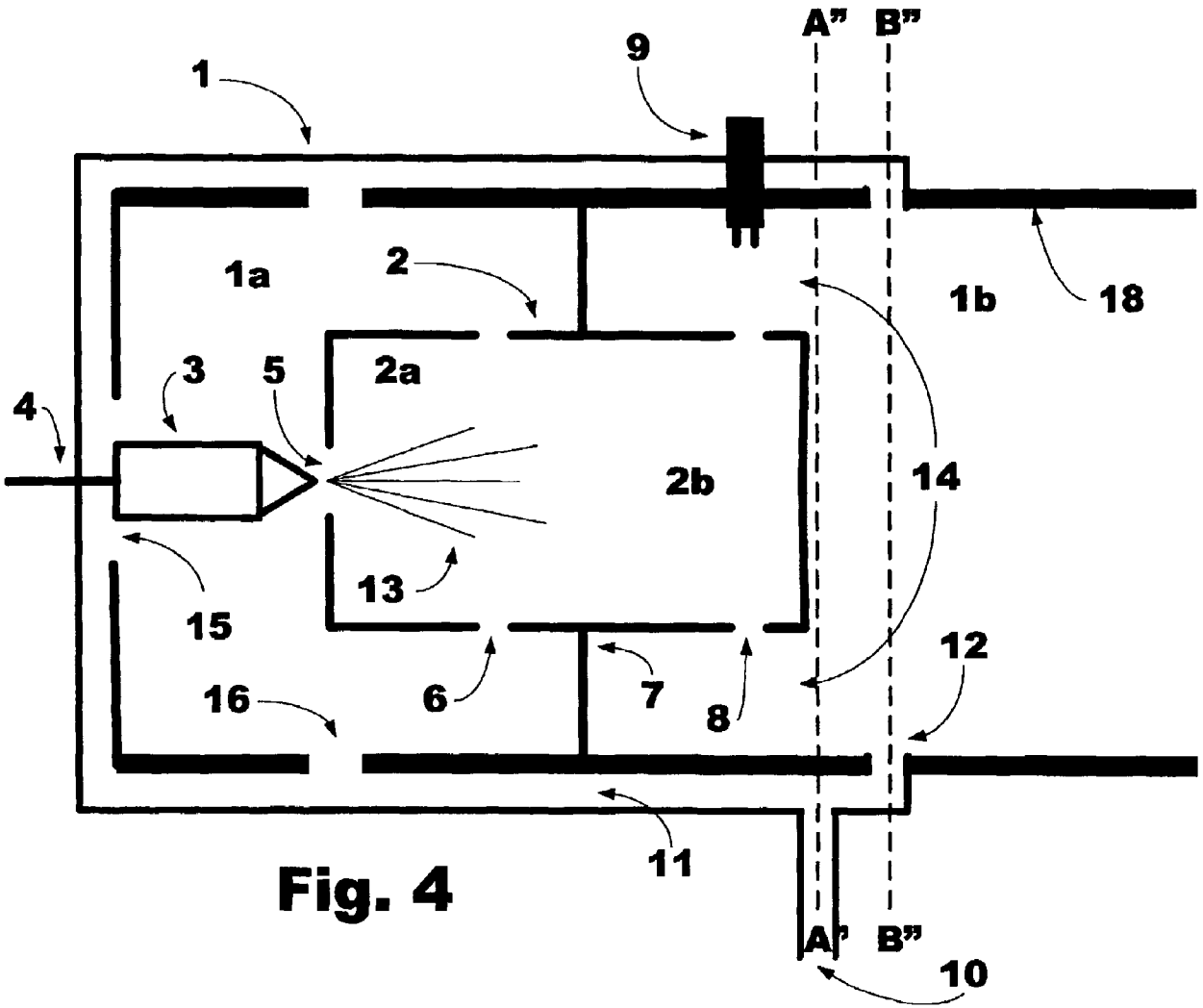
FIG. 4 is a longitudinal cross-sectional view according to a second embodiment of the present invention.
Figures 5A, 5B:
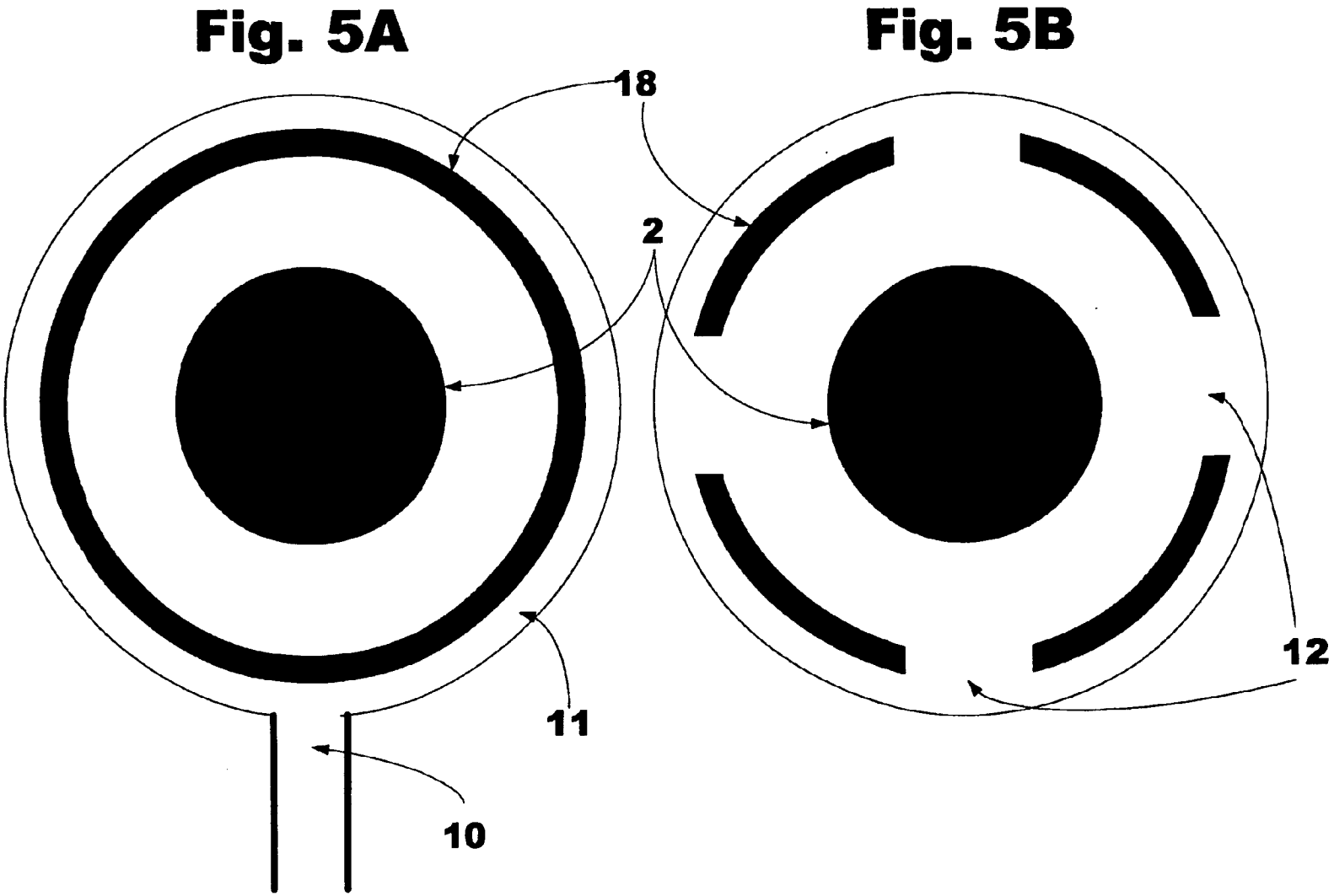
FIG. 5A is cross-sectional view of FIG. 4 taken along line A"—A"
FIG. 5B is cross-sectional view of FIG. 4 taken along line B"—B"

A second preferred embodiment of the present invention is illustrated in FIG. 4. In addition to the basic elements described above and illustrated in FIG. 2, this second embodiment includes an air inlet 10 and a channel 11 for introducing air around the combustor liner 18. With this arrangement, once a flame is established in the combustion zone 14, the air entering inlet 10 and flowing along the outside of the portion of combustor liner 18 enclosing the hot portion 1*b* of the combustor is preheated before entering the cool portion 1*a* of the combustor. The preheated air can be introduced into the cool portion 1*a* of the combustor through an axial inlet 15 and/or radial inlets 16 and into the cool portion 2*a* of the PPC 2 through inlets 5 and 6 to improve the evaporation of the fuel emerging from the fuel injector 3. In addition to preheating the air before mixing with the liquid fuel, the embodiment illustrated in FIG. 4 also provides some cooling for the portion of the combustor liner 18 enclosing the hot portion 1*b* of the combustor. In addition to supplying preheated air to the PPC 2 and cooling the combustor liner 18, a portion of the air entering though inlet 10 may also be introduced into the hot portion of the combustor 1*b* though one or more radial inlets 12 to cool and dilute the combustion products emerging from the combustion zone 14 before they enter any downstream processes.

Figure 6:
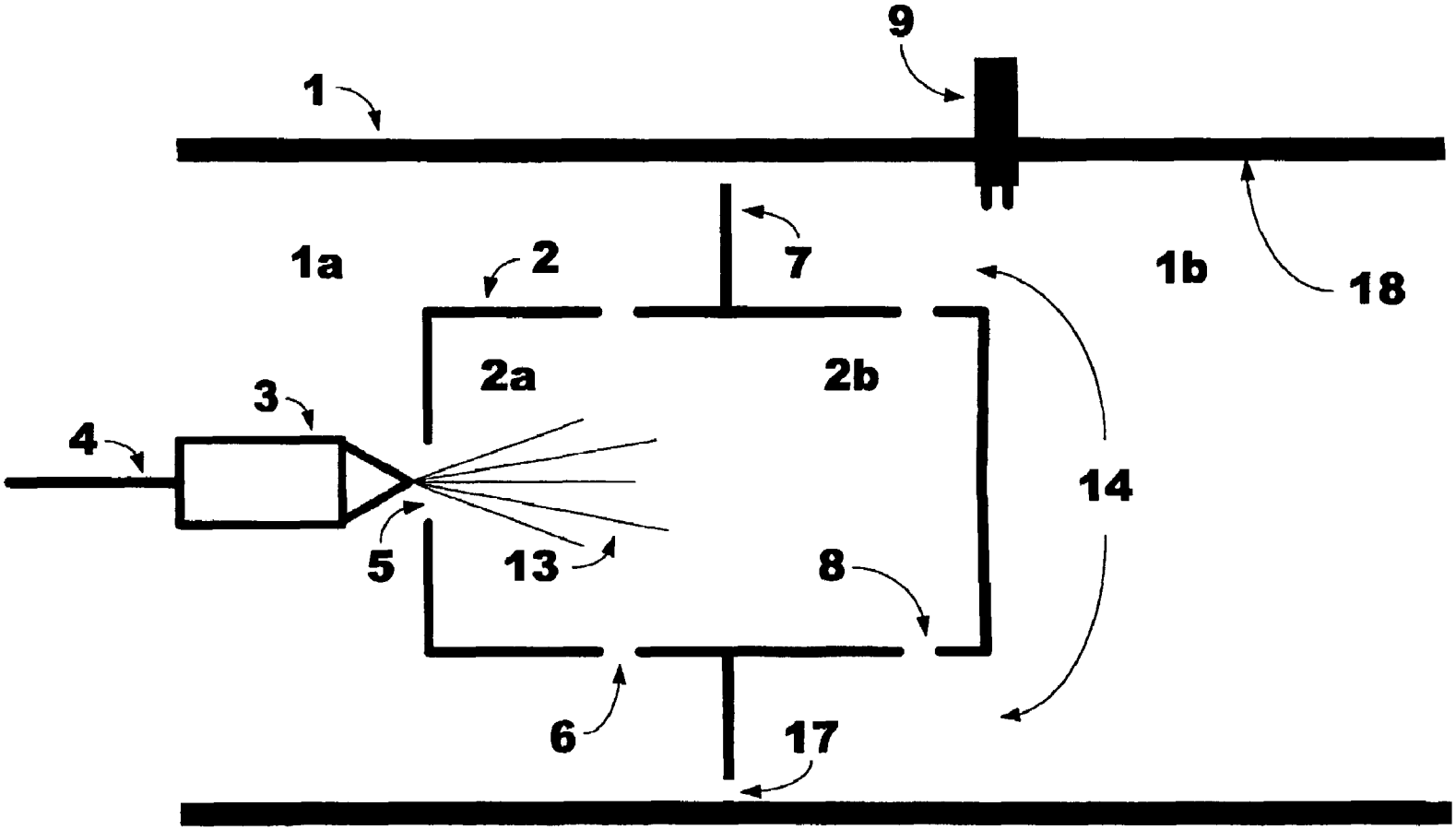
FIG. 6 is a longitudinal cross-sectional view according to a third embodiment of the present invention.

A third embodiment of the present invention is illustrated in FIG. 6. In addition to the basic elements illustrated and discussed with respect to FIGS. 2 and 4, the combustor illustrated in FIG. 6 includes one or more gaps 17 between the periphery of the PPC flange 7 and the combustor liner 18 that will allow some portion of the air introduced into the cool portion 1*a* of the combustor to enter the hot portion 1*b* of the combustor without first passing through the PPC. If such gaps exist, however, they should be sized so that the portion of air flowing through gaps 17 is maintained at a sufficiently low level to ensure that the exit velocity of the combustion mixture exiting outlets 8 remains adequate to prevent flashback and that a stable flame may be maintained in the combustion zone 14.

A combustor according to the present invention is capable of quickly establishing a stable, non-sooting flame at both lean equivalence ratios between 0.3 and 1.0 and low-rich ratios between 1.0 and 1.2. Even when the fuel/air mixture is adjusted to equivalent ratios above 1.2, the present invention provides a substantially cleaner flame than that obtained with prior art diffusion burners operating at the same ratios.

According to the principles of the present invention, a combustor is provided for quickly establishing a lean or low-rich, non-sooting that is capable of quickly heating downstream fuel processor components to achieve proper operating temperatures for startup. Furthermore, the combustor according to the present invention allows control of the heat input into the fuel processor while minimizing the tendency to form carbon. Still further, a combustor according to the present invention provides a means of heating downstream fuel processor components while minimizing both the use of electrical energy during startup and the reliance on exothermic catalytic reactions. Still further, the present invention provides improved transient carbon monoxide concentration performance by ensuring substantially complete combustion of the fuel and rapid warm up of one or more of the reformer components.

The description and illustrations of the present invention are merely exemplary in nature and, thus, variations are not to be regarded as a departure from the spirit and scope of the invention.

What is claimed is:

1. A combustor comprising:

a combustor liner enclosing a cool portion and a hot portion of the combustor;

a pre-mix, pre-evaporation chamber positioned within the combustor liner providing a cool portion having an inlet opening from the cool portion of the combustor, a hot portion having an outlet opening into the hot portion of the combustor, and a flange extending from an outer surface of the pre-mix, pre-evaporation chamber toward the combustor liner and separating the hot portion of the combustor from the cool portion of the combustor;

a fuel injector positioned adjacent the inlet opening for injecting liquid fuel into the pre-mix, pre-evaporation chamber through the inlet opening; and an igniter positioned in the hot portion of the combustion chamber adjacent the outlet opening;

wherein the liquid fuel injected into the pre-mix, pre-evaporation chamber from the injector mixes with air entering the pre-mix, pre-evaporation chamber through the inlet opening and evaporates substantially completely to form a combustion mixture of air and fuel vapor before exiting the pre-mix, pre-evaporation chamber through the outlet opening;

and further wherein the combustion mixture is ignited and is substantially consumed in a non-sooting flame within a combustion zone adjacent the outlet opening to produce a hot exhaust stream.

2. A combustor according to claim 1 wherein:

the inlet opening comprises both an axial inlet opening and a plurality of radial inlet openings arranged around a periphery of the cool portion of the pre-mix, pre-evaporation chamber, the fuel injector being positioned adjacent the axial inlet opening.

3. A combustor according to claim 2 wherein:

the axial inlet opening is approximately centrally located in a rear face of the pre-mix, pre-evaporation chamber.

4. A combustor according to claim 2 wherein:

a ratio of the volume of air entering the pre-mix, pre-evaporation chamber from the axial inlet opening and the volume of air entering the pre-mix, pre-evaporation chamber through the radial inlet openings is between 1 and 3.

5. A combustor according to claim 1 wherein:

fuel entering the pre-mix, pre-evaporation chamber remains in the pre-mix, pre-evaporation chamber for an average residence time before exiting the pre-mix, pre-evaporation chamber through the outlet opening, the average residence time being between 5 milliseconds and 20 milliseconds.

6. A combustor according to claim 1 wherein:

the combustion mixture exiting the outlet opening has an average exit velocity sufficient both to prevent flashback into the pre-mix, pre-evaporation chamber and to prevent blowout of the non-sooting flame in the combustion zone.

7. A combustor according to claim 6 wherein:

the average exit velocity is between 5 meters/second and 50 meters/second.

8. A combustor according to claim 1 wherein:

the outlet opening comprises a plurality of radial outlet openings around a periphery of the hot portion of the pre-mix, pre-evaporation chamber.

9. A combustor according to claim 8 wherein:

the outlet opening further comprises an axial opening located on a front face of the pre-mix, pre-evaporation chamber.

10. A combustor according to claim 1 wherein:

a ratio of a length of the cool portion of the pre-mix, pre-evaporation chamber and a length of the hot portion of the pre-mix, pre-evaporation chamber is between about 1 and 3.

11. A combustor according to claim 1 wherein:

a ratio of a length of the pre-mix, pre-evaporation chamber and a diameter of the pre-mix, pre-evaporation chamber is between about 1 and 5.

12. A combustor according to claim 1 wherein:

a ratio of a diameter of the combustion liner and a diameter of the pre-mix, pre-evaporation chamber is between about 2 and 6.

13. A combustor according to claim 1 wherein:

a ratio of a volume of the cool portion of the pre-mix, pre-evaporation chamber and a volume of the hot portion of the pre-mix, pre-evaporation chamber is between about 0.2 and 3.

14. A combustor according to claim 1 wherein:

a ratio of a diameter of the cool portion of the pre-mix, pre-evaporation chamber and a diameter of the hot portion of the pre-mix, pre-evaporation chamber is between about 0.5 and 2.

15. A combustor according to claim 1 further comprising:

a cool air inlet adjacent the hot portion of the combustor and an air channel extending along and adjacent a surface of the combustor liner from the cool air inlet to a preheated air inlet into the cool portion of the combustor, whereby air entering the cool air inlet is preheated by thermal energy from the combustor liner before entering the cool portion of the combustor.

16. A combustor according to claim 15 wherein:

a temperature difference between air entering the cool air inlet and preheated air entering the cool portion of the combustor is at least 100° C.

17. A combustor according to claim 16 wherein:

a temperature difference between air entering the cool air inlet and preheated air entering the cool portion of the combustor is at least 250° C.

18. A combustor according to claim 15 further comprising:

a dilution air inlet, the dilution air inlet being fluidly connected to the cool air inlet and located in a portion of the combustor liner surrounding the hot portion of the combustor for introducing air into the hot exhaust stream.

19. A combustor according to claim 18 wherein:

the dilution air inlet further comprises a plurality of radial dilution air openings arranged around a peripheral portion of the combustion liner.

20. A fuel processor of the type having a reformer operable for converting a hydrogen-containing fuel to a $H_2$-containing reformate, a clean-up reactor in fluid communication with the reformer and operable for reducing carbon monoxide levels of the reformate, and a combustor in fluid communication with at least one of the reformer and the clean-up reactor, the combustor comprising:

a combustor liner enclosing a cool portion and a hot portion of the combustor;

a pre-mix, pre-evaporation chamber positioned within the combustor liner providing a cool portion having an inlet opening from the cool portion of the combustor, a hot portion having an outlet opening into the hot portion of the combustor, and a flange extending from an outer surface of the pre-mix, pre-evaporation chamber toward the combustor liner and separating the hot portion of the combustor from the cool portion of the combustor;

a fuel injector positioned adjacent the inlet opening for injecting liquid fuel into the pre-mix, pre-evaporation chamber wherein the liquid fuel is evaporated in air to produce a combustion mixture; and an igniter positioned in the hot portion of the combustor adjacent the outlet opening for igniting the combustion mixture;

the combustor being operable to ignite and substantially consume the combustion mixture in a non-sooting flame within a combustion zone in the hot portion of the combustor adjacent the outlet opening to produce a hot exhaust stream for increasing the temperature of at least one of the reformer, the shift reactor and the preferential oxidation reactor.

* * * * *